United States Patent [19]

Carpenter

[11] Patent Number: 4,632,480

[45] Date of Patent: Dec. 30, 1986

[54] QUICKLY RELEASEABLE CONNECTORS

[75] Inventor: Brian J. Carpenter, Ramsgate, England

[73] Assignee: Allied Corporation, Morris Township, Morris County, N.J.

[21] Appl. No.: 746,421

[22] Filed: Jun. 19, 1985

[30] Foreign Application Priority Data

Jun. 23, 1984 [GB] United Kingdom ..... 8416087

[51] Int. Cl.[4] ..... H01R 13/635

[52] U.S. Cl. ..... 339/45 M

[58] Field of Search ..... 339/45 R, 45 M, 91 R

[56] References Cited

U.S. PATENT DOCUMENTS

| | | | |
|---|---|---|---|
| 3,452,316 | 6/1969 | Panek et al. | 339/45 M |
| 4,208,082 | 6/1980 | Davies et al. | 339/45 M |
| 4,421,373 | 12/1983 | Ratchford et al. | 339/45 M |
| 4,521,064 | 6/1985 | Knapp et al. | 339/45 M |

FOREIGN PATENT DOCUMENTS

| | | | |
|---|---|---|---|
| 1130881 | 8/1982 | Canada | 339/45 M |
| 2063218 | 7/1971 | France . | |
| 2510823 | 2/1983 | France . | |
| 2054980 | 2/1981 | United Kingdom . | |

*Primary Examiner*—Gil Weidenfeld
*Assistant Examiner*—Gary F. Paumen
*Attorney, Agent, or Firm*—Roger H. Criss

[57] ABSTRACT

A quickly releaseable electrical connector assembly has an inner generally tubular member (1) for carrying a functional connector element and a female screw thread (20) provided by a plurality of segmental elements rotatable by an operating sleeve (5) in relation to a complimentary male thread of a receiving connector, the operating sleeve being biased by springs (28) and (29) towards a position wherein a cam surface thereof acts on surfaces (21) of the segmental elements to hold them in operative engagement and the elements are pivotally retained in position between a retaining ring (12) keyed to the operating sleeve and an annular retaining flange (6) on the tubular member (1).

10 Claims, 4 Drawing Figures

QUICKLY RELEASEABLE CONNECTORS

BACKGROUND OF THE INVENTION

1. Field of the Invention

This invention relates to quickly releaseable connectors and relates especially but not exclusively to electrical connectors.

2. Description of the Prior Art

Electrical connectors have been proposed which comprise a first plug connector part adapted to be coupled to and functionally connected with a second receiving connector part, the plug part carrying a rotatable member rotation of which effects by means of screw threads full mutual engagement and retention between the parts.

It has also been proposed to provide such a connector with release means whereby it may be instantly manually released by pulling a lanyard without the necessity for reverse rotation of the rotatable member. In one form of release means for such a connector an internally screw threaded assembly has been proposed comprising a number of segments retained in position by the encircling rotatable member. Axial displacement of the rotatable member by pulling a lanyard attached thereto permits instant outward separation of the segments to disengage them from the receiving part.

The aforementioned previously proposed connector is quite complex, intricate to assembly and susceptible to some wear and the present invention seeks to provide an improved quickly releaseable connector.

SUMMARY OF THE INVENTION

According to the present invention there is provided a quickly releaseable connector for functional connection with a receiving connector, the assembly having a generally annular outer member rotatable coaxially about an inner member which carries a functional connecting part, a retaining member between said members rotatably located for rotation with the outer member and extending around an inner portion of at least one segmental element to trap and retain said portion substantially in engagement with the inner member, the inner portion of the or each segmental element being thereby also axially positioned but angularly moveable relative to the axis, said segmental element or elements each have a screw threaded part and being keyed for rotation with the outer member to be mutually cooperable with a screw thread of the receiving connector, the annular member and segmental element or elements having interacting cam surfaces whereby axial movement of the annular member from a first locking position to a second release position permits such pivoted angular movement of the element or elements out of engagement with the screw thread of the receiving connector for releasing the connector assembly.

The present invention thus provides an improved quickly releaseable connenctor of less complex design, which is easy to assemble and subject to less wear.

DESCRIPTION OF THE PREFERRED EMBODIMENTS

Figure 1:
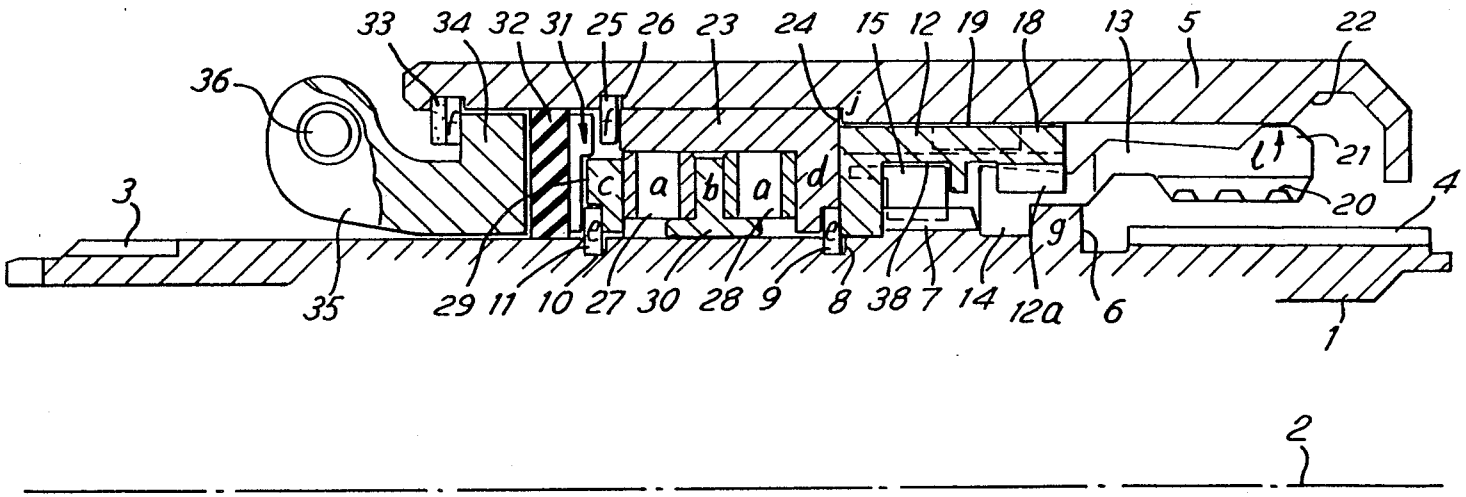
FIG. 1 illustrates in diagrammatical form on an enlarged scale a half section of a connector assembly in accordance with the invention.

Referring to the drawings, the connector assembly has an inner generally cylindrical part 1 within which a multi-contact electrical plug connector is positioned and angularly located about the axis 2 of the assembly by being provided in usual manner with keys and keyways not shown. The part 1 is provided at one end with a screw thread 3 for attachment of an accessory or cable clamp and, at the other end, suitably spaced key sections 4 are provided to enable unique polarising positioning thereof in relation to keyways of a receiving connector which is not shown. The receiving connector is provided with a functional electrical connecting element which co-operates with the complimentary functional element retained in part 1 and has an external screw thread by means of which a connector assembly such as shown in the drawing can be assembled thereto by rotation of our outer operating sleeve 5.

Figure 2:
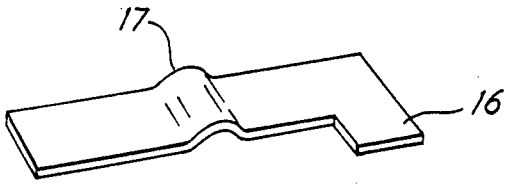
FIG 2. illustrates one of three leaf springs used in assembly of FIG. 1.

The inner part 1 is provided, additionally to the key sections 4 at the right hand end as shown in the drawing, with a retaining annular flange 6 and an annular flange 7 bearing click-stop teeth on its outer periphery, an annular groove 8 for receiving a retaining circlip 9 and a further annular groove 10 for receiving a further retaining circlip 11. Rotatably retained between the left hand flange 7 and circlip 9, there is provided a retaining ring 12 with spacing elements **12*a* creating arcuate recesses for the inner ends of six segmental elements 13, radial inward projections 14 of which are retained between flanges 6 and 7 as shown. A further annular recess 38 in the retaining ring 12 accommodates a plurality of click-stop rotation restraining springs as indicated by reference 15. These restraining springs are three in number and are as shown in FIG. 2, each being provided with a locating projection 16 which engage respective small drillings in 12 and ridges 17 of the springs resiliently engage with the toothed peripheral surface of flange 7 of inner part 1**. A greater or smaller number of such springs may be included, if required.

Figure 3:
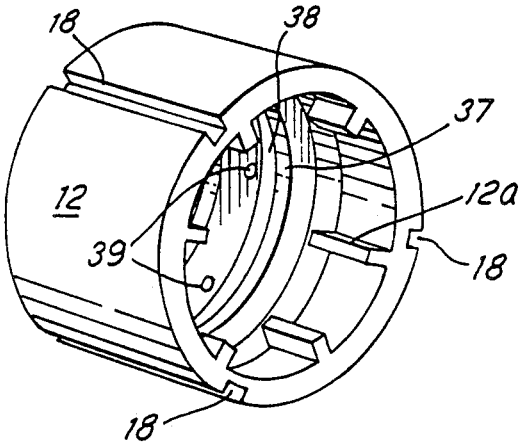
FIG. 3 illustrates a view of an annular retaining member included in the assembly of FIG. 1.

Referring to FIG. 3 which shows more detail of the annular retaining ring 12 than is visible in the sectional view of FIG. 1, the spacing elements **12*a* which separate the six threaded segments 13 are clearly visible. An annular ridge 37 forms one side of the mentioned recess 38 the other side of which is provided with the mentioned small drillings 39 (two of which are shown) for retaining the projections 16 of one of the leaf springs 15. The retaining ring 12 is further provided with the three keyways 18 accommodating keys, one of which 19 is shown dotted in FIG. 1 formed on the inner surface of operating sleeve 5 whereby rotation of sleeve 5 is communicated via the retaining ring 12 and spacers 12*a* to each segmental element 13**.

The elements 13 are provided on their inner surfaces facing the part 1 with segments of screw threads 20 and on their outer face with cam projections 21 with surfaces which on leftward axial movement of operating sleeve 5 can be accommodated in an annular depression 22 providing a complimentary cam surface. The mentioned segmental screw threads are formed such that with the segments in the position shown the threads mate with a corresponding complete male thread of the receiving connector.

Leftward of the annular circlip 9, there is provided a spring assembly including an annular carrier 23 the right hand end of which is engageable with an inner shoulder 24 of the operating sleeve 5 and the left hand end of which is retained in relation to sleeve 5 by an annular circlip 25 in a groove 26. The right hand end of carrier 23 is recessed for circlip so as to bear against the adjacent face of the retaining ring 12 and two wave-springs 27 and 28 separated by an annular spacer 30 are provided trapped between the right hand end of the annular carrier 23 and an annular stop 29 retained by circlip 10. Leftward of the circlip 10 an annular seal retaining ring 31 is provided followed by a suitable ice seal 32 outwardly of which is located by double circlips 33, an annular flange 34 of a rotatable lanyard ring 35 which carries two symetrically placed projecting eyes 36 to receive a release lanyard or other means.

By virtue of the design of the arrangement described above, manual assembly thereof is quite simply achieved. The six threaded segmental elements 13 are placed around the inner member 1 with their flanges engaged behind the flange 6. The retaining ring 12 together with the three leaf springs 15 assembled thereto is then pushed into position from the left before insertion of the circlip 9. The spring carrier 23 together with the wave springs 28, 29 and the intermediate spacer 30 are then inserted followed by the circlip 25 then being positioned. A suitable compression device is then employed to press the retainer ring 29 against the force of the springs to permit insertion of the circlip 10. The seal ring 31, the seal 32 and the lanyard ring 35 are then readily positioned and the assembly is completed by the insertion of the double circlips 33.

Figure 4:
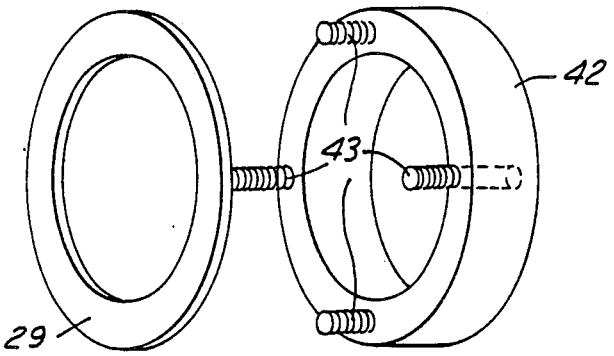
FIG. 4 illustrates an alternative spring means that may be employed in an assembly according to the invention.

By virtue of the fact that the carrier 23 bears against the retaining ring 12 under the normal force of the springs 27 and 28 in the locked position shown, any tendency to uncouple by vibration is reduced by the steady internal frictional resistance which is provided additional to the more positive click-stop effect of the ridges 17 interacting with the tooth periphery of flange 7 when member 15 is rotated. Although wave springs 28 and 29 are conveniently employed as spring means between stop 29 and member 22 alternative spring means may be employed if desired. One such alternative is shown in FIG. 4 where an annular cage 42 carries a plurality of coil springs 43 to co-operate with the stop ring 29. The cage 42 thus replaces the member 23 of FIG. 1 and the components within it.

In operation of the connector in FIG. 1, the connector is presented and appropriately aligned with a receiving connector as determined by the polarising keys 4 and key ways in known manner. Rotation of the operating sleeve 5 results in rotation of the rotating ring 12 and the segmental elements 13 located in respective recesses thereof. By virtue of the wavesprings or other spring medium acting between the stop 29 through carrier 23, the outer rotatable operating sleeve 5 is held in a first locking position wherein the segmental elements 13 are retained in the position shown by the action of the cam surfaces 21. In this position, rotation of the operating sleeve causes mutual screw thread engagement between thread 20 and a corresponding male thread on the receiving part thereby drawing the functional connector part of the assembly into full mating engagement with the functional connector part of the receiving connector. In the event that it is required to quickly release the connector assembly from the receiving connector, a substantial leftward force is applied to the lanyard or other means attached to the eyes 36 and such force is thereby transmitted through the lanyard ring 35, the double circlips 33 and the internal shoulder 24 of the operating ring to the carrier 23. Such force results in compression of wave springs 27 and 28 against the stop ring 29 permitting leftward movement of the operating sleeve in relation to the remaining components including retaining ring 12 and segments 13 towards a second release position. The cam projections 21 on segment 13 are thereby permitted to move outward into the annular recess 22, whereby the threaded portions 20 immediately and quickly disengage from the male thread on the receiving connector.

What is claimed is:

1. A quickly releaseable connector for functional connection with a receiving connector, said releaseable connector having a generally annular outer member rotatable coaxially about an inner member which carries a functional connecting part, a retaining member between said members rotatably located for rotation with the outer member and extending around an inner portion of at least one segmental element to trap and retain said portion substantially in engagement with the inner member, the inner portion of said segmental element being thereby also axially positioned but angularly moveable relative to the longitudinal axis of said releaseable connector, said segmental element having a screw threaded part and being keyed for rotation with the outer member to be mutually cooperable with a screw thread of the receiving connector, said annular member and segmental element having interacting cam surfaces whereby axial movement of the annular member from a first locking position to a second release position permits pivoted angular movement of said element out of engagement with the screw thread of the receiving connector for releasing the receiving connector, and a spring carrier carrying spring means acting axially between said inner member and said outer annular member in a sense to retain the outer member in the locking position, said spring carrier being located between a stop carried by the inner member and said annular retaining member, and being normally biased against said annular retaining member.

2. A quickly releaseable connector as claimed in claim 1 wherein the inner portion of the segmental element comprises a radially inwardly directed flange retained in an annular recess of the inner member.

3. A quickly releaseable connector as claimed in claim 2 wherein said annular recess is a recess provided between two annular flanges.

4. A quickly releaseable connector as claimed in claim 3 wherein the innermost of said flanges has a toothed periphery resiliently engaged by a rotation restraining click-stop located in said retaining member.

5. A quickly releaseable connector as claimed in claim 4 having a plurality of such elements circumferentially spaced around the inner member by radial spacers carried by the rotatable retaining member.

6. A quickly releaseable connector as claimed in claim 1 having a further annular member rotatably located within the annular outer member and carrying mean for attachment of a release member or lanyard.

7. A quickly releaseable connector as claimed in claim 6 including an annular seal retained forward of said further annular member.

8. A quickly releasable connector as claimed in claim 4, wherein said retaining member extends over both of said flanges.

9. A quickly releasable connector as claimed in claim 8, wherein said element is pivotable at its inner portion.

10. A quickly releasable connector as claimed in claim 9, including an inwardly extending flange at the forward end of said outer member.

* * * * *